US010174397B2

(12) United States Patent
Rosenberg et al.

(10) Patent No.: US 10,174,397 B2
(45) Date of Patent: Jan. 8, 2019

(54) TITANIUM-FREE ALLOY

(71) Applicant: VDM Metals International GmbH, Werdohl (DE)

(72) Inventors: Julia Rosenberg, Iserlohn (DE); Jutta Kloewer, Duesseldorf (DE)

(73) Assignee: VDM Metals International GmbH, Werdohl (DE)

( * ) Notice: Subject to any disclaimer, the term of this patent is extended or adjusted under 35 U.S.C. 154(b) by 147 days.

(21) Appl. No.: 15/035,366

(22) PCT Filed: Feb. 10, 2015

(86) PCT No.: PCT/DE2015/000053

§ 371 (c)(1),
(2) Date: May 9, 2016

(87) PCT Pub. No.: WO2015/120832

PCT Pub. Date: Aug. 20, 2015

(65) Prior Publication Data

US 2017/0002437 A1 Jan. 5, 2017

(30) Foreign Application Priority Data

Feb. 13, 2014 (DE) ..... 10 2014 002 402
Feb. 28, 2014 (DE) ..... 10 2014 002 693

(51) Int. Cl.
*C21D 9/08* (2006.01)
*C21D 1/26* (2006.01)
(Continued)

(52) U.S. Cl.
CPC ..... *C21D 9/52* (2013.01); *C21D 1/26* (2013.01); *C21D 6/004* (2013.01); *C21D 8/005* (2013.01);
(Continued)

(58) Field of Classification Search
CPC ..... C21D 9/52
See application file for complete search history.

(56) References Cited

U.S. PATENT DOCUMENTS 2,777,766 A 1/1957 Binder
6,918,968 B2 7/2005 Semba et al.
(Continued)

FOREIGN PATENT DOCUMENTS

CN 1540026 A 10/2004
CN 101688263 A 3/2010
(Continued)

OTHER PUBLICATIONS

Benninghoff, Hans: Wärmebehandlung der Bau- und Werkzeugstähle, 3. Auflage; Basel: BAZ Buchverlag, 1978, S. 156—ISBN 3858150401, total of 3 pages, with English translation.
(Continued)

*Primary Examiner* — Colleen P Dunn
*Assistant Examiner* — Rajinder Bajwa
(74) *Attorney, Agent, or Firm* — Collard & Roe, P.C.

(57) ABSTRACT

Titanium-free alloy which has great resistance to pitting and crevice corrosion and a high yield point in the strain-hardened state and includes (in wt %) a maximum of 0.02% C, a maximum of 0.01% S, a maximum of 0.03% N, 20.0-23.0% Cr, 39.0-44.0% Ni, 0.4-<1.0% Mn, 0.1-<0.5% Si, >4.0-<7.0% Mo, a maximum of 0.15% Nb, >1.5-<2.5% Cu, 0.05-<0.3% Al, a maximum of 0.5% Co, 0.001-<0.005% B, 0.005-<0.015% Mg, the remainder consisting of Fe and smelting-related impurities.

3 Claims, 3 Drawing Sheets

(51) Int. Cl.

| | |
|---|---|
| ***C21D 9/52*** | (2006.01) |
| ***C22C 38/00*** | (2006.01) |
| ***C22C 38/08*** | (2006.01) |
| ***C22C 38/18*** | (2006.01) |
| ***C22C 38/20*** | (2006.01) |
| ***C22C 38/22*** | (2006.01) |
| ***C22C 38/40*** | (2006.01) |
| ***C22C 38/42*** | (2006.01) |
| ***C22C 38/44*** | (2006.01) |
| ***C22C 38/52*** | (2006.01) |
| ***C22C 38/54*** | (2006.01) |
| ***C21D 6/00*** | (2006.01) |
| ***C21D 8/02*** | (2006.01) |
| ***C21D 8/00*** | (2006.01) |
| ***C21D 8/10*** | (2006.01) |
| ***C21D 9/00*** | (2006.01) |
| ***C21D 9/46*** | (2006.01) |
| ***C22C 1/02*** | (2006.01) |
| ***C22C 30/02*** | (2006.01) |
| ***C22C 30/00*** | (2006.01) |

(52) U.S. Cl.

CPC ..... *C21D 8/021* (2013.01); *C21D 8/0221* (2013.01); *C21D 8/0226* (2013.01); *C21D 8/0247* (2013.01); *C21D 8/0263* (2013.01); *C21D 8/105* (2013.01); *C21D 9/0068* (2013.01); *C21D 9/0081* (2013.01); *C21D 9/08* (2013.01); *C21D 9/46* (2013.01); *C22C 1/02* (2013.01); *C22C 30/00* (2013.01); *C22C 30/02* (2013.01); *C22C 38/004* (2013.01); *C22C 38/08* (2013.01); *C22C 38/18* (2013.01); *C22C 38/20* (2013.01); *C22C 38/22* (2013.01); *C22C 38/40* (2013.01); *C22C 38/42* (2013.01); *C22C 38/44* (2013.01); *C22C 38/52* (2013.01); *C22C 38/54* (2013.01)

(56) References Cited

U.S. PATENT DOCUMENTS

| | | | | |
|---|---|---|---|---|
| 8,701,455 | B2 | 4/2014 | Sagara et al. | |
| 8,784,581 | B2 | 7/2014 | Igarashi et al. | |
| 2008/0068634 | A1 | 3/2008 | Takano et al. | |
| 2009/0285717 | A1 | 11/2009 | Hattendorf | |
| 2010/0313988 | A1* | 12/2010 | Matsuo | B24C 1/086 138/177 |
| 2016/0032425 | A1* | 2/2016 | Hattendorf | C22C 19/057 420/443 |

FOREIGN PATENT DOCUMENTS

| | | | | | |
|---|---|---|---|---|---|
| DE | 10 2007 005 605 | A1 | | 8/2008 | |
| EP | 1 471 158 | A1 | | 10/2004 | |
| EP | 2 163 655 | A1 | | 3/2010 | |
| GB | 2 123 031 | A | | 1/1984 | |
| GB | 2123031 | A | * | 1/1984 | C22C 30/00 |
| JP | S57-210940 | A | | 12/1982 | |
| JP | S58-199851 | A | | 11/1983 | |
| JP | S58-199852 | A | | 11/1983 | |
| JP | S 61-288041 | A | | 12/1986 | |
| WO | 2006/003952 | A1 | | 1/2006 | |
| WO | 2006/003953 | A1 | | 1/2006 | |

OTHER PUBLICATIONS

International Search Report of PCT/DE2015/000053, dated Jun. 8, 2015.

Benninghoff, Hans: Wärmebehandlung der Bau- und Werkzeugstähle, 3. Auflage; Basel: BAZ Buchverlag, 1978, S. 156—ISBN 3858150401, 3 pages.

* cited by examiner

| Alloy 825 / PV No. | 942-1 | 506-1 | 507-1 | 942-0 | 507-0 | 942-2 | 506-2 | 507-2 | 942-3 | 506-3 |
|---|---|---|---|---|---|---|---|---|---|---|
| $L_0$ [mm] | 185 | 185 | 185 | 110 | 110 | 110 | 110 | 110 | 110 | 110 |
| $v_{max}$ [mm/min] | 45 | 45 | 45 | 45 | 45 | 60 | 60 | 60 | 75 | 75 |
| Heat treatment | WG | LG | LG | WG | LG | WG | LG | LG | WG | LG |
| Type of 1st hot crack | WAR | WAR | WAR | WAR | WAR | WAR | WAR | WAR | WAR | WAR |

LG = solution-annealed
WG = soft-annealed

TITANIUM-FREE ALLOY

CROSS REFERENCE TO RELATED APPLICATIONS

This application is the National Stage of PCT/DE2015/000053 filed on Feb. 10, 2015, which claims priority under 35 U.S.C. § 119 of German Application Nos. 10 2014 002 402.4 filed on Feb. 13, 2014 and 10 2014 002 693.0 filed on Feb. 28, 2014, the disclosures of which are incorporated by reference. The international application under PCT article 21(2) was not published in English.

The invention relates to a titanium-free alloy with high pitting and crevice corrosion resistance as well as high offset yield strength and tensile strength in the cold-worked condition.

The high-corrosion-resistant material Alloy 825 is used for critical applications in the chemical industry and in the offshore technology. It is marketed under the material number 2.4858 and has the following chemical composition: C≤0.025%, S≤0.015%, Cr 19.5-23.5%, Ni 28-46%, Mn≤1%, Si≤0.5%, Mo 2.5-3.5%, Ti 0.6-1.2%, Cu 1.5-3%, Al≤0.2%, Co≤1%, Fe the rest.

For new applications in the oil and gas industry, the pitting and crevice corrosion resistance (problem 1) as well as the offset yield strength and tensile strength (problem 2) are too low.

As regards the low chromium and molybdenum content, Alloy 825 has only a relatively low effective sum (PRE=1×% Cr+3.3×% Mo). By the effective sum PRE, the person skilled in the art understands the Pitting Resistance Equivalent.

The alloy that is Alloy 825 is a titanium-stabilized alloy. However, titanium may lead to problems, especially in continuous casting, since it reacts with the $SiO_2$ of the casting powder (problem 3). It would be desirable to avoid the element titanium, but that would lead to a significant increase of the edge-cracking tendency.

JP 61288041 A1 relates to an alloy of the following composition: C<0.045%, S<0.03%, N 0.005-0.2%, Cr 14-26%, Mn<1%, Si<1%, Mo<8%, Cu<2%, Fe<25%, Al<2%, B 0.001-0.1%, Mg 0.005-0.5%, the rest Ni. The content of Nb is generated by a formula. Furthermore, at least one of the elements Ti, Al, Zr, W, Ta, V, Hf may be present in contents≤2.

U.S. Pat. No. 2,777,766 discloses an alloy of the following composition: C<0.25%, Cr 18-25%, Ni 35-50%, Mo 2-12%, Nb 0.1-5%, Cu up to 2.5%, W up to 5%, Fe the rest (min. 15%).

The task of the invention is to provide an alloy alternative to Alloy 825 that remedies the problems outlined above and

- is titanium-free,
- has a high pitting and crevice corrosion resistance,
- has a higher offset yield strength in the cold-worked condition,
- has at least equally good hot formability and weldability.

Furthermore, a process for manufacture of the alloy will be presented.

This task is accomplished by a titanium-free alloy with high pitting corrosion resistance with (in wt %)

C max. 0.02%
S max. 0.01%
N max. 0.03%
Cr 20.0-23.0%
Ni 39.0-44.0%
Mn 0.4-<1.0%
Si 0.1-<0.5%

Mo>4.0-<7.0%
Nb max. 0.15%
Cu>1.5-<2.5%
Al 0.05-<0.3%
Co max. 0.5%
B 0.001-<0.005%
Mg 0.005-<0.015%
Fe the rest as well as melting-related impurities.

Advantageous improvements of the alloy according to the invention can be inferred from the associated objective dependent claims.

DETAILED DESCRIPTION OF PREFERRED EMBODIMENTS

Figure 1:
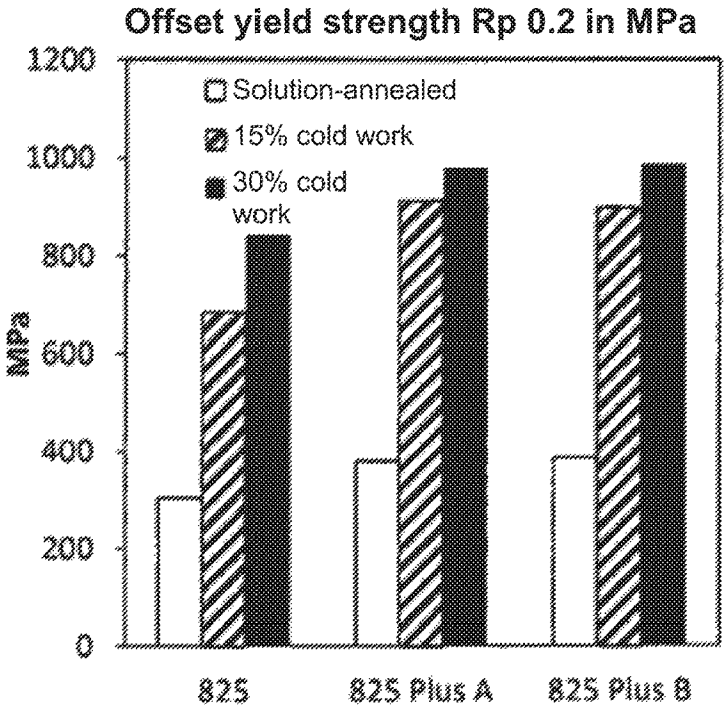
FIGS. 1 and 2 are graphical representations of the results of tension tests at room temperature (mean values) versus condition.

An expedient embodiment of the alloy according to the invention has the following composition (in wt %)

C max. 0.015%
S max. 0.005%
N max. 0.02%
Cr 21.0-<23%
Ni>39.0-<43.0%
Mn 0.5-0.9%
Si 0.2-<0.5%
Mo>4.5-6.5%
Nb max. 0.15%
Cu>1.6-<2.3%
Al 0.06-<0.25%
Co max. 0.5%
B 0.002-0.004%
Mg 0.006-0.015%
Fe the rest as well as melting-related impurities.

The content of chromium may be further modified if necessary as follows:

Cr >21.5-<23%
Cr 22.0-<23%

The nickel content may be further modified if necessary as follows:

Ni >39.0-<42%
Ni >39.0-<41%

The molybdenum content may be further modified if necessary as follows:

Mo >5-<6.5%
Mo >5-<6.2%

The content of copper may be further adjusted if necessary as follows:

Cu >1.6-<2.0%

If necessary, the element V may also be added to the alloy in contents (in wt %) of

V >0-1.0%
V 0.2-0.7%

The iron content in the alloy according to the invention should be >22%.

If the element titanium is left out, then—as explained above—edge cracks develop during rolling. The cracking tendency can be positively influenced by magnesium on the order of 50-150 ppm. The associated/investigated laboratory heats are listed in Table 1.

TABLE 1

Influence of deoxidizing elements on the edge-cracking tendency during hot rolling

| Element in wt % | C | S | N | Cr | Ni | Mn | Si | Mo | Ti | Nb | Cu | Fe | Al | B | Mg in ppm | Ca in ppm | Edge cracks |
|---|---|---|---|---|---|---|---|---|---|---|---|---|---|---|---|---|---|
| Ref 825 | 0.002 | 0.0048 | 0.006 | 22.25 | 39.41 | 0.8 | 0.3 | 3.27 | 0.8 | 0.01 | 2 | R | 0.14 | 0 | — | — | no |
| LB2181 | 0.002 | 0.004 | 0.006 | 22.57 | 39.76 | 0.8 | 0.3 | 3.27 | 0.4 | 0.01 | 2.1 | R | 0.12 | 0 | — | — | slight |
| LB2182 | 0.006 | 0.003 | 0.052> | 22.46 | 39.71 | 0.8 | 0.3 | 3.27 | — | 0.01 | 2 | R | 0.11 | 0 | — | — | yes |
| LB2183 | 0.002 | 0.004 | 0.094> | 22.65 | 39.61 | 0.8 | 0.3 | 3.28 | — | 0.01 | 1.9 | R | 0.1 | 0 | — | — | yes |
| LB2218 | 0.005 | 0.0031 | 0.048> | 22.50 | 39.59 | 0.8 | 0.3 | 3.27 | — | 0.01 | 2 | R | 0.12 | 0.01 | 100 | — | no |
| LB2219 | 0.005 | 0.0021 | 0.043> | 22.71 | 39.99 | 0.8 | 0.3 | 4.00> | — | 0.01 | 2 | R | 0.10 | 0.01 | 100 | — | no |
| LB2220 | 0.004 | 0.00202 | 0.042> | 22.66 | 39.64 | 0.8 | 0.33 | 4.93> | — | 0.01 | 2 | R | 0.11 | 0 | 100 | — | no |
| LB2221 | 0.004 | 0.0022 | 0.038> | 22.43 | 39.66 | 0.8 | 0.3 | 3.74> | — | 0.01 | 1.9 | R | 0.11 | 0 | 10 | — | yes |
| LB2222 | 0.003 | 0.0033 | 0.042> | 22.5 | 39.62 | 0.8 | 0.3 | 3.66> | — | 0.01 | 2 | R | 0.18 | 0 | 20 | — | yes |
| LB2223 | 0.002 | 0.0036 | 0.041> | 22.4 | 39.78 | 0.7 | 0.3 | 3.65> | — | 0.01 | 2.00 | R | 0.27> | 0 | 20 | — | yes |
| LB2234 | 0.003 | 0.005 | 0.007 | 22.57 | 39.77 | 0.8 | 0.3 | 3.26 | — | 0.01 | 2.1 | R | 0.15 | 0 | 80 | 10 | no |
| LB2235 | 0.003 | 0.0034 | 0.006 | 22.56 | 39.67 | 0.8 | 0.3 | 3.28 | — | 0.01 | 2.1 | R | 0.12 | 0 | 150 | 12 | no |
| LB2236 | 0.002 | 0.004 | 0.006 | 22.34 | 39.46 | 0.8 | 0.3 | 3.27 | — | 0.01 | 2 | R | 0.11 | 0 | 30 | 42 | slight |
| LB2317 | 0.001 | 0.0025 | 0.030 | 22.48 | 40.09 | 0.8 | 0.3 | 4.21 | — | 0.01 | 2 | R | 0.16 | 0 | 100 | 5 | no |
| LB2318 | 0.002 | 0.0036 | 0.038> | 22.76 | 39.77 | 0.8 | 0.3 | 5.20> | — | 0.01 | 2.1 | R | 0.15 | 0 | 100 | 4 | no |
| LB2319 | 0.002( | 0.0039 | 0.043> | 22.93> | 39.79 | 0.8 | 0.3 | 6.06 | — | 0.01 | 2.2 | R | 0.12 | 0 | 100 | 3 | no |
| LB2321 | 0.002 | 0.0051 | 0.040> | 22.56 | 40.23> | 0.7 | 0.3 | 6.23 | — | 0.01 | 2.1 | R | 0.10 | 0 | 100 | 4 | no |

The effective sum PRE in regard to the corrosion resistance of the Alloy 825 is equal to PRE 33 and is very low compared with other alloys. Table 2 shows the effective sums PRE according to the prior art.

TABLE 2

Effective sum PRE for various alloys corresponding to the prior art

| Alloy | Ni | Fe | Cr | Mo | Others | PRE |
|---|---|---|---|---|---|---|
| Duplex 2205 | 5.5 | Rest | 22 | 3 | 0.15 N | 37 |
| 825 | 40 | 31 | 23 | 3.2 | | 33 |
| 28 | 31 | 35 | 27 | 3.5 | 1.3 Cu | 38 |
| 926 | 25 | Rest | 19 | 6 | 0.16 N | 47 |

This effective sum and therefore the corrosion resistance can be increased by raising the molybdenum content. PRE=1×% Cr+3.3×% Mo (Pitting Resistance Equivalent).

Table 3 shows the results of diverse pitting corrosion investigations. The reduced titanium content has no negative influence on the pitting corrosion temperature. The raised molybdenum content has positive effects.

TABLE 3

Critical pitting corrosion temperature in 6% $FeCl_3$ + 1% HCl, over 72 hours (ASTM G-48 Method C).

| | T in ° C. | Ni | Cr | Mo | N | Ti | PRE |
|---|---|---|---|---|---|---|---|
| LB 2316 | 35 | 39.2 | 22.4 | 3.1 | 0.04 | <0.04 | 33 |
| LB 2317 | 40 | 40.1 | 22.5 | 4.2 | 0.03 | <0.04 | 36 |
| LB 2318 | 50 | 39.8 | 22.8 | 5.2 | 0.04 | <0.04 | 40 |
| LB 2319 | 55 | 38.8 | 22.9 | 6.1 | 0.04 | <0.04 | 43 |
| LB 2320 | 50 | 39 | 22.1 | 6.2 | 0.1 | <0.03 | 43 |
| LB 2321 | 50 | 40.2 | 22.6 | 6.2 | 0.04 | 0.4 | 43 |
| LB 2322 | 40 | 40 | 23.1 | 6.3 | 0.1 | 0.4 | 44 |
| Alloy 825Reference | 30 | 40 | 23 | 3.2 | <0.02 | 0.8 | 33 |

Further corrosion investigations likewise revealed an improvement of the critical crevice corrosion temperatures compared with Alloy 825. These are presented in Table 4.

TABLE 4

Critical pitting corrosion temperature (CPT) and crevice corrosion temperature (CCT)

| Alloy | CPT in ° C. | CCT in ° C. | Ni | Cr | Mo | V | Ti | PRE |
|---|---|---|---|---|---|---|---|---|
| 825* | 30 | <5 | | | | | | 33 |
| PV661 | 40 | 15 | 40 | 23 | 3.3 | <0.002 | 0.8 | 34 |
| PV662 | 50 | 20 | 40 | 23 | 5.9 | <0.002 | <0.002 | 42 |
| PV663 | 50 | 20 | 39 | 23 | 5.8 | 0.4 | <0.002 | 42 |

The offset yield strength and the tensile strength can be improved by 15% and 30% cold-working. The associated investigation results of diverse laboratory alloys are listed in the following table.

TABLE 5

Tension tests at RT

| Condition | Alloy | Rp0.2 | Rm | A (%) | Z (%) |
|---|---|---|---|---|---|
| Solution-annealed | 825 Reference | 304 | 646 | — | 51 |
| | 825 Plus (A) | 389 | 754 | 39 | 59 |
| | | 369 | 772 | 39.5 | 61 |
| | 825 Plus (B) | 390 | 765 | 42.5 | 62 |
| | | 383 | 755 | 40 | 63 |
| 15% cold work | 825 | 670 | 775 | 22 | 71 |
| | | 697 | 793 | 19.5 | 65 |
| | | 685 | 779 | 23.5 | 69 |
| | 825 Plus (A) | 903 | 973 | 14.5 | 51 |
| | | 893 | 964 | 13.5 | 50 |
| | | 943 | 987 | 13.5 | 54 |
| | 825 Plus (B) | 929 | 974 | 12.5 | 56 |
| | | 877 | 964 | 12.5 | 51 |
| | | 887 | 962 | 9.5 | 49 |
| 30% cold work | 825 | 852 | 923 | 14 | 63 |
| | | 832 | 922 | 13.5 | 66 |
| | | 842 | 920 | 17.5 | 64 |
| | 825 Plus (A) | 979.0 | 1071.0 | 11.5 | 51.0 |
| | | 970.0 | 1079.0 | 8.5 | 35.0 |
| | | 996.0 | 1078.0 | 11.0 | 46.0 |

TABLE 5-continued

| Tension tests at RT | | | | | |
|---|---|---|---|---|---|
| Condition | Alloy | Rp0.2 | Rm | A (%) | Z (%) |
| | 825 Plus (B) | 980.0 | 1078.0 | 11.5 | 47.0 |
| | | 980.0 | 1071.0 | 11.0 | 48.0 |
| | | 996.0 | 1083.0 | 10.5 | 48.0 |

Figure 2:
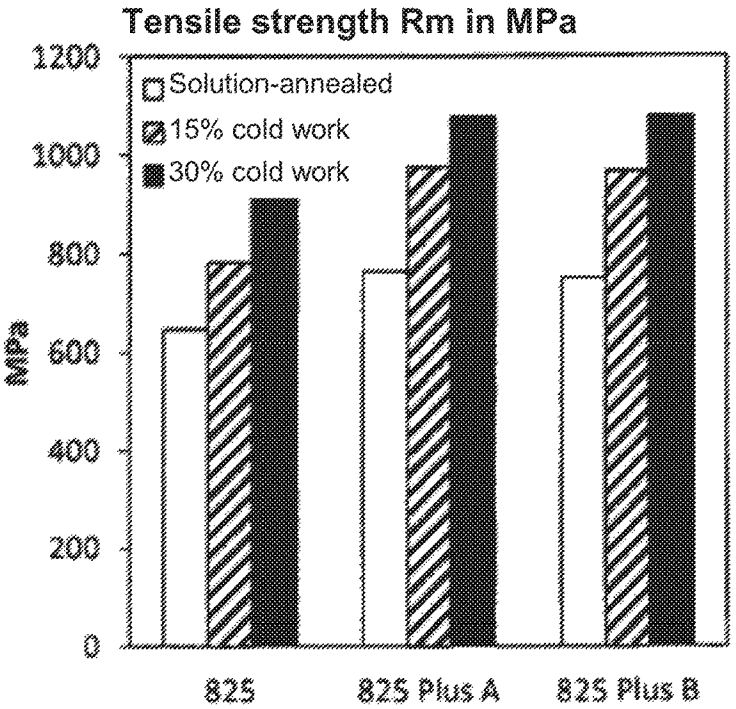

FIGS. 1 and 2 show results of tension tests, on the one hand for the reference alloy 825 and on the other hand for alternative alloys.

Figure 3:
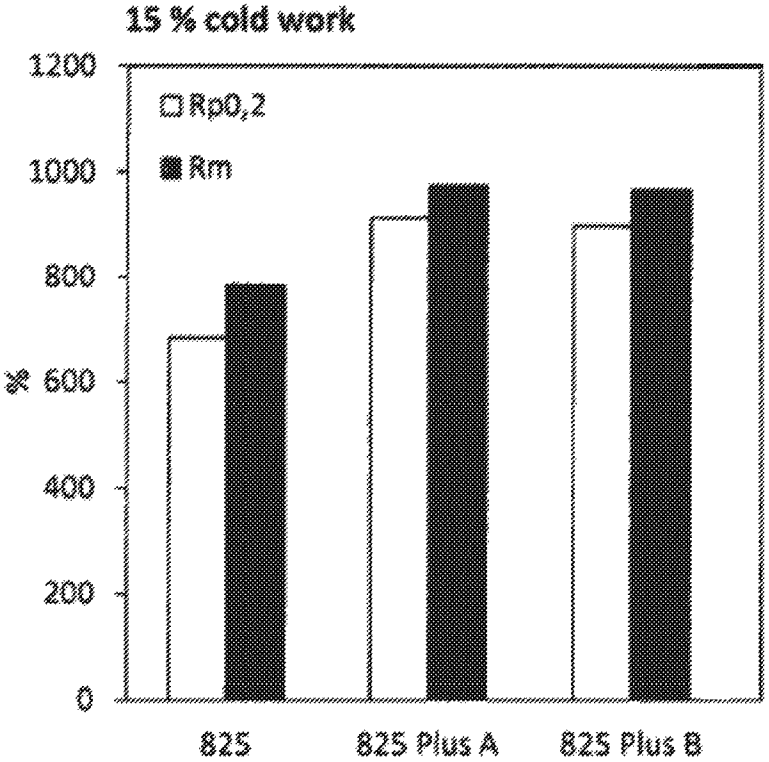
FIGS. 3 and 4 are graphical representations of the results of tension tests at room temperature (mean values) versus molybdenum content.
Figure 4:
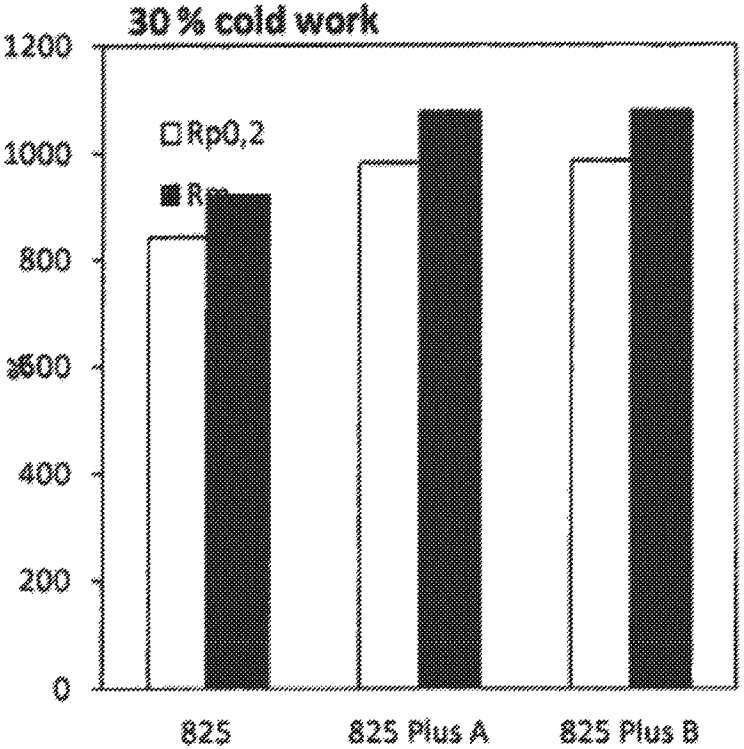
Figure 5:
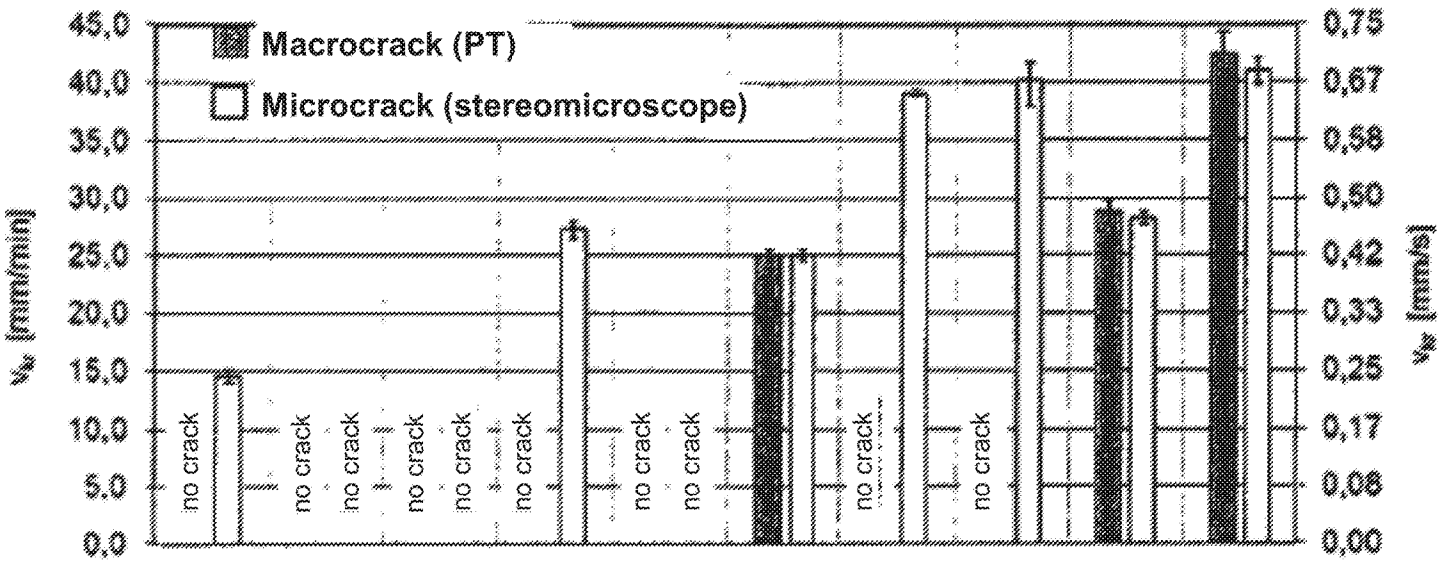
FIG. 5 shows critical deformation rates for the first hot crack (PT and stereomicroscope inspection) on Alloy 825, regardless of the type of cracking.

Molybdenum has a positive effect on the offset yield strength and the tensile strength. The positive influence of molybdenum is illustrated in FIGS. 3 and 4.

The hot-cracking sensitivity of the Alloy 825, which is an Ni-base alloy, was investigated by means of the PVR test (program-controlled deformation cracking test). The critical crosshead speed $V_{cr}$ in tension was determined by applying a linearly increasing crosshead speed during TIG welding. The investigation results are illustrated in the following graph. The weldability of the material became better with higher crosshead speed and smaller hot-cracking tendency. The titanium-free, high-molybdenum variants (PV 506 and PV 507) exhibited fewer cracks than the standard alloy (PV 942).

TABLE 6

| (chemical composition in wt %) | | | | | | | | | |
|---|---|---|---|---|---|---|---|---|---|
| Heat | C | Mn | Si | P | S | Cr | Ni | Mo | Ti |
| 942 (Prior art) | 0.006 | 0.76 | 0.28 | 0.012 | 0.002 | 22.65 | 39.42 | 3.17 | 0.80 |
| 506 (invention) | 0.01 | 0.86 | 0.31 | 0.005 | 0.005 | 23.2 | 39.0 | 4.9 | 0.06 |
| 507 (invention) | 0.01 | 0.86 | 0.31 | 0.005 | 0.005 | 23.2 | 39.2 | 5.9 | 0.06 |
| Heat | V | Nb | Cu | Fe | Al | Co | B | N | W |
| 942 (Prior art) | | | 1.94 | R30.5 | 0.14 | 0.11 | | | |
| 506 (invention) | 0.01 | 0.13 | 2.4 | 28.8 | 0.14 | 0.28 | 0.003 | 0.02 | 0.10 |
| 507 (invention) | 0.01 | 0.13 | 2.4 | 28.7 | 0.14 | 0.28 | 0.003 | 0.02 | 0.11 |

The task is also accomplished by a process for the manufacture of an alloy that has a composition according to one of the objective claims, wherein a) the alloy is melted openly in the continuous or ingot casting, b) to eliminate the segregations caused by the increased molybdenum content, a homogenizing annealing of the produced blooms/billets is performed at 1150-1250° C. for 15 to 25 h, wherein c) the homogenizing annealing is performed in particular following a first hot forming.

Optionally, the alloy may also be produced by ESR/VAR remelting.

The alloy according to the invention will preferably be used as a structural part in the oil and gas industry.

Product forms suitable for this purpose are sheets, strips, pipes (longitudinally welded and seamless), bars or forgings.

Table 7 compares Alloy 825 (standard) with two alloys according to the invention.

TABLE 7

| (chemical composition in wt %) | | | | | | | | | |
|---|---|---|---|---|---|---|---|---|---|
| Heat | C | Mn | Si | P | S | Cr | Ni | Mo | Ti |
| PV 661 (Prior art) | 0.006 | 0.75 | 0.28 | 0.003 | | 22.9 | 39.9 | 3.32 | 0.79 |
| PV 662 (invention) | 0.0066 | 0.75 | 0.26 | 0.003 | 0.0011 | 22.9 | 39.7 | 5.86 | 0.002 |
| PV 663 (invention) | 0.0071 | 0.77 | 0.28 | 0.004 | 0.0013 | 22.7 | 39.4 | 5.76 | <0.002 |
| Heat | V | Nb | Cu | Fe | Al | Co | B | N | Mg |
| PV 661 (Prior art) | <0.002 | 0.004 | 1.81 | 29.8 | 0.148 | 0.01 | 0.003 | 0.0011 | 0.012 |
| PV 662 (invention) | <0.002 | <0.002 | 1.80 | 28.4 | 0.142 | 0.009 | 0.003 | 0.0016 | 0.01 |
| PV 663 (invention) | 0.37 | 0.004 | 1.81 | 28.5 | 0.155 | 0.005 | 0.003 | 0.0015 | 0.01 |

The invention claimed is:

1. A process for the manufacture of a titanium-free alloy with pitting and crevice corrosion resistance as well as offset yield strength in the cold-worked condition, with the following composition in weight %:

| | |
|---|---|
| C | max. 0.02% |
| S | max. 0.01% |
| N | max. 0.03% |
| Cr | 20.0-23.0% |
| Ni | 39.0-44.0% |
| Mn | 0.4-<1.0% |
| Si | 0.1-<0.5% |
| Mo | >4.0-<7.0% |
| Nb | max. 0.15% |
| Cu | >1.5-<2.5% |
| Al | 0.05-<0.3% |
| Co | max. 0.5% |
| B | 0.001-<0.005% |
| Mg | 0.005-<0.015% |
| V | 0.2-0.7% |
| Fe | the rest as well as melting-related impurities |

wherein a) the alloy is melted openly in continuous or ingot casting, b) to eliminate the segregations caused by the increased molybdenum content, a homogenizing annealing of the produced blooms/billets is performed at 1150-1250° C. for 15 to 25 h, wherein c) the homogenizing annealing is performed in particular following a first hot forming.

2. The process according to claim 1 wherein the alloy has the following composition in weight %:

| | |
|---|---|
| C | max. 0.015% |
| S | max. 0.005% |
| N | max. 0.02% |
| Cr | 21.0-<23% |
| Ni | >39.0-<43.0% |
| Mn | 0.5-0.9% |
| Si | 0.2-<0.5% |
| Mo | >4.5-6.5% |
| Nb | max. 0.15% |
| Cu | >1.6-<2.3% |
| Al | 0.06-<0.25% |
| Co | max. 0.5% |
| B | 0.002-0.004% |

-continued

| | |
|---|---|
| Mg | 0.006-0.015% |
| V | 0.2-0.7% |
| Fe | the rest as well as melting-related impurities. |

3. The process according to claim 1 wherein the alloy has the following composition in weight %:

| | |
|---|---|
| Cr | 21.5-<23% |
| Ni | >39.0-<42% |
| Mn | 0.4-<1.0% |
| Si | 0.2-<0.5% |
| Mo | >5-<6.5% |
| Cu | >1.6-<2.2% |
| Al | 0.05-<0.3% |
| B | 0.001-<0.005% |
| Mg | 0.005-0.015% |
| V | 0.2-0.7% |
| Fe | the rest as well as melting-related impurities. |

* * * * *